US008851232B2

(12) United States Patent
Raoul Bingham

(10) Patent No.: US 8,851,232 B2
(45) Date of Patent: Oct. 7, 2014

(54) ROPE CLIMBING APPARATUS

(76) Inventor: Samuel Kevin Raoul Bingham, Detroit, MI (US)

( * ) Notice: Subject to any disclaimer, the term of this patent is extended or adjusted under 35 U.S.C. 154(b) by 115 days.

(21) Appl. No.: 13/293,193

(22) Filed: Nov. 10, 2011

(65) Prior Publication Data

US 2012/0118666 A1 May 17, 2012

Related U.S. Application Data

(60) Provisional application No. 61/456,731, filed on Nov. 12, 2010.

(51) Int. Cl.
*A62B 1/14* (2006.01)
*A63B 27/00* (2006.01)
*A63B 29/02* (2006.01)

(52) U.S. Cl.
CPC .. *A63B 29/02* (2013.01); *A62B 1/14* (2013.01)
USPC ..... 182/5; 182/192; 182/133

(58) Field of Classification Search
USPC ..... 182/5, 193, 192, 133
See application file for complete search history.

(56) References Cited

U.S. PATENT DOCUMENTS 138,051 A * 4/1873 Shaw ..... 182/7
439,529 A * 10/1890 Larsen ..... 188/65.5
542,641 A * 7/1895 Hembacher ..... 188/65.5
2,557,499 A * 6/1951 Davis ..... 24/68 CD
2,896,283 A * 7/1959 Huber ..... 24/71.1
3,340,964 A * 9/1967 Glover ..... 188/65.4
3,389,765 A 6/1968 Pressley, Sr.
3,542,158 A * 11/1970 Arnold ..... 188/65.5
3,707,022 A 12/1972 Diehl
4,596,314 A * 6/1986 Rogelja ..... 188/65.5
4,671,384 A 6/1987 Sing
5,850,893 A * 12/1998 Hede et al. ..... 182/193
6,899,203 B1 * 5/2005 Golden et al. ..... 188/65.4
7,353,910 B2 * 4/2008 Klingler ..... 182/5
7,905,676 B2 * 3/2011 Halder ..... 403/322.2

FOREIGN PATENT DOCUMENTS

GB 2256673 A * 12/1992
GB 2340173 6/1999

OTHER PUBLICATIONS

International Search Report, PCT/US2012/026893; May 31, 2012.
Written Opinion PCT/US2012/026893; May 31, 2012.

* cited by examiner

*Primary Examiner* — Alvin Chin-Shue
(74) *Attorney, Agent, or Firm* — Fildes & Outland, P.C.

(57) ABSTRACT

A rope climbing apparatus includes two spaced side members. Each side member has a climbing rope end and a tethering end. The climbing rope ends each include a pair of spaced apertures. The tethering ends each include a cooperative aperture. Two friction elements are disposed between the spaced side members. The friction elements are axially disposed between the pair of spaced apertures in the climbing rope end for receiving a rope therebetween the friction elements. A tether connector is axially disposed between the cooperative apertures in the tethering end for connecting a tether thereto. The climbing apparatus is useable as a brake while descending a rope through angular movement of the tethering end relative to the rope.

1 Claim, 8 Drawing Sheets

FIG. 1
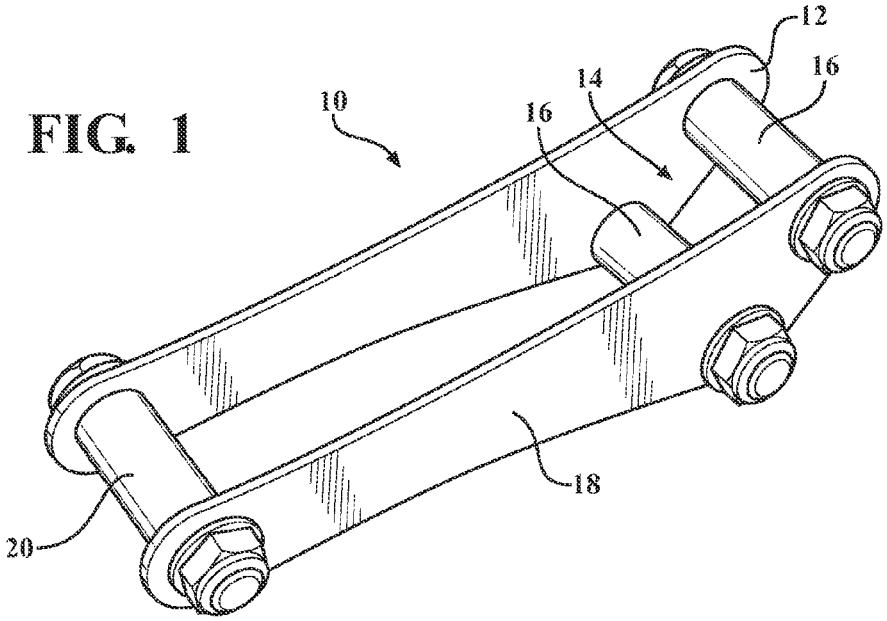
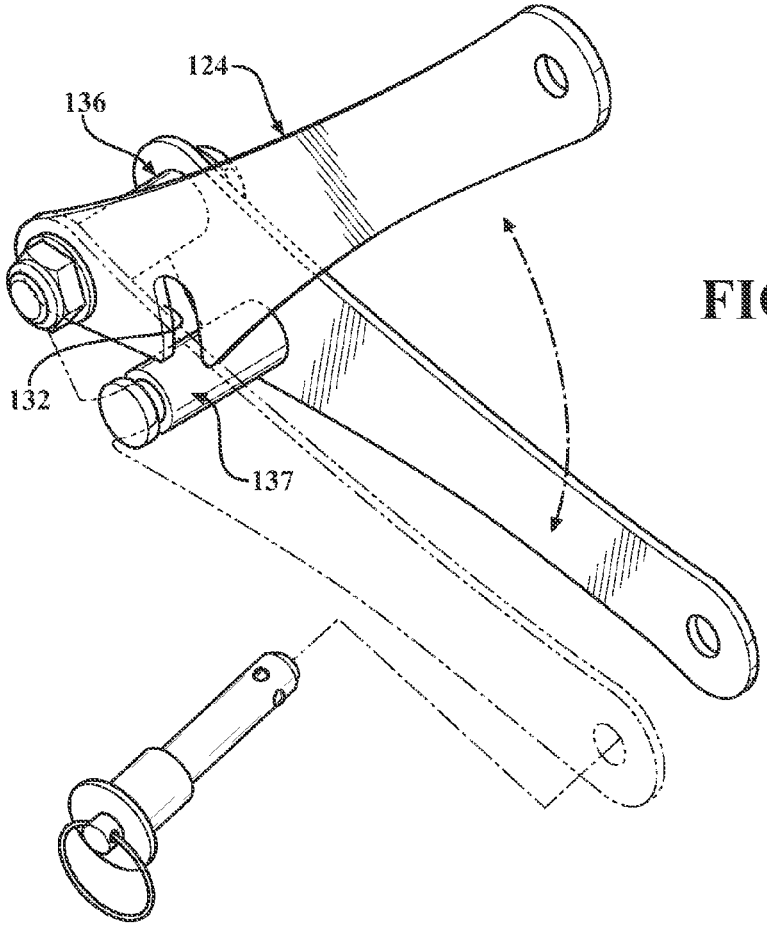
FIG. 5

FIG. 2
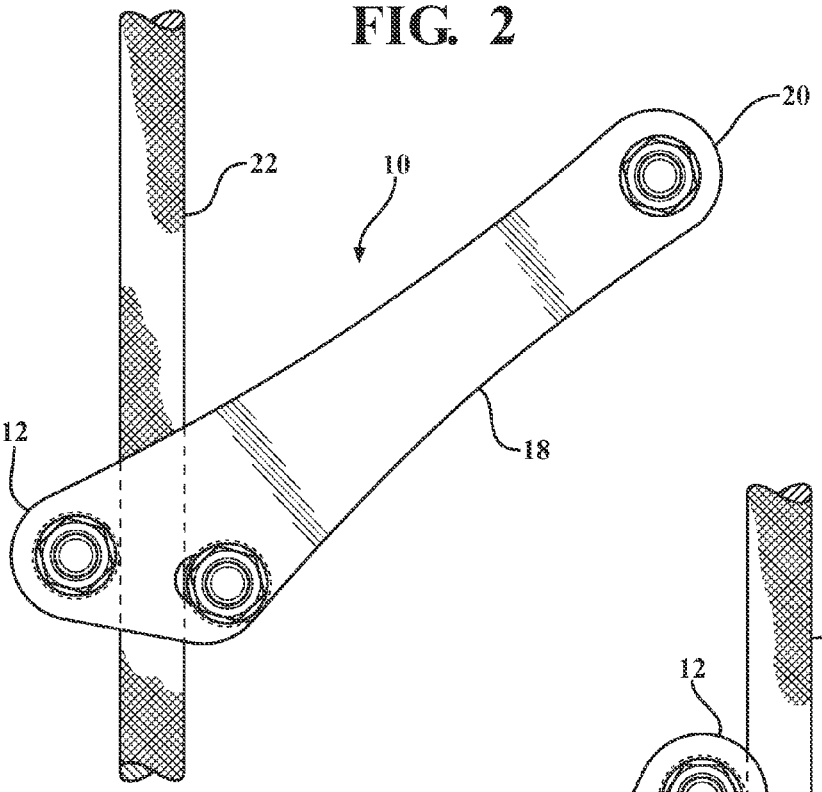
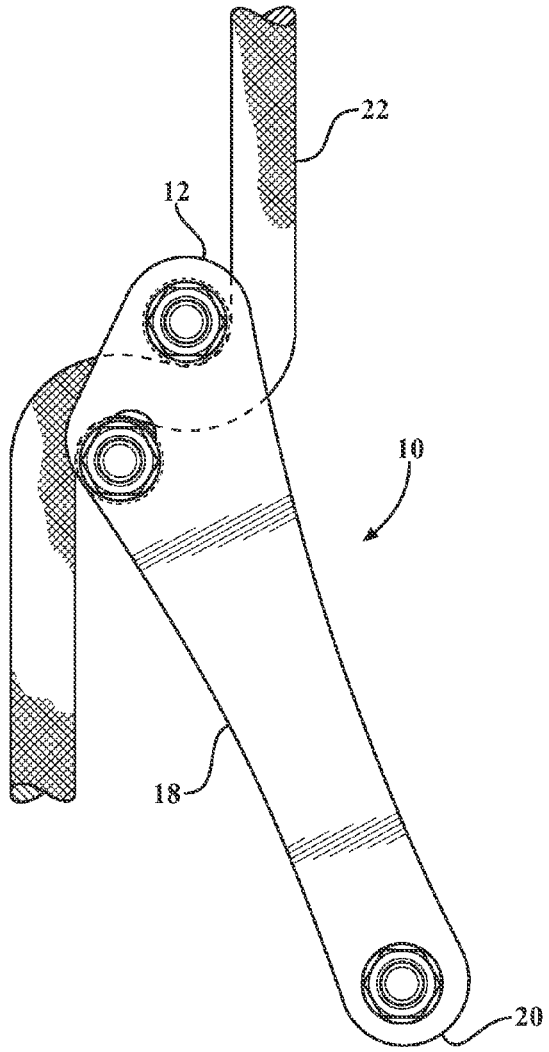
FIG. 3

FIG. 6
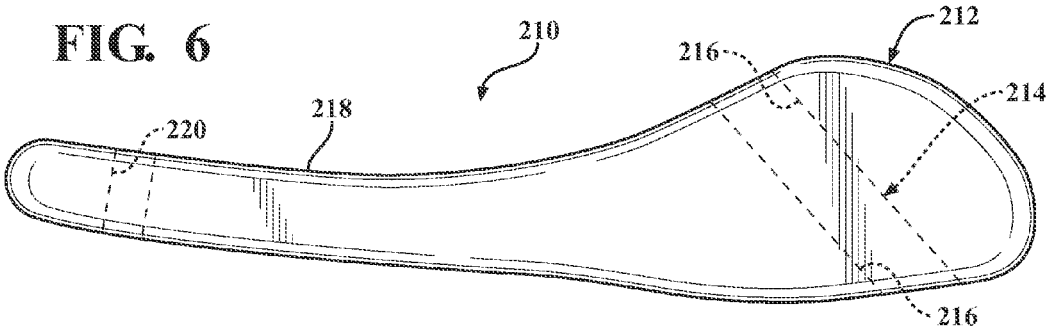
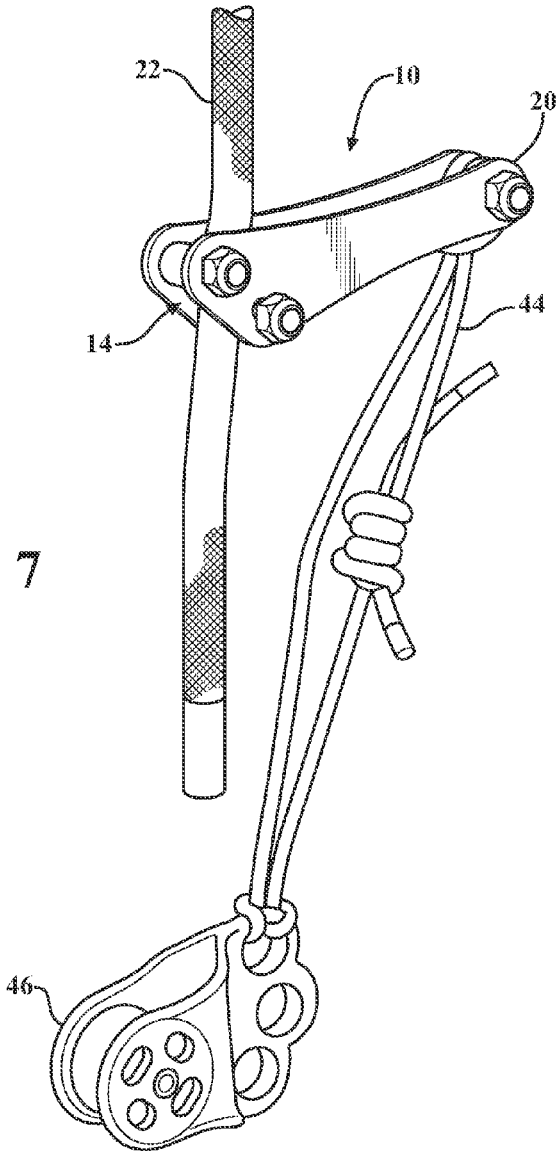
FIG. 7

ROPE CLIMBING APPARATUS

CROSS REFERENCE TO RELATED APPLICATION

This application claims the priority of U.S. Provisional Application No. 61/456,731 filed Nov. 12, 2010.

TECHNICAL FIELD

This invention relates to tree climbing apparatus, and more particularly to an apparatus for rope climbing using a single rope technique.

BACKGROUND OF THE INVENTION

It is known in the art relating tree climbing and specifically rope assisted tree climbing to use a doubled rope technique (DdRT). DdRT involves the use of a loop of rope (i.e., a doubled rope) to both ascend and descend. A single line of rope is positioned over a branch of a tree using a rope placement device or similar and connected as an adjustable loop using a friction component such as a friction hitch or similar. A branch protection device through which the rope passes may also be used. The tie-in point (TIP) is therefore a branch of the tree. The climber then attaches to the loop and uses his/her arms and/or legs to ascend the rope. As the climber ascends, the loop becomes smaller; thus, the rope is dynamic and constantly moving with the climber. To descend, the climber gently loosens the hitch to slowly increase the size of the loop, which causes the climber to move downward along the rope. Due to the doubling over of the climbing rope, DdRT is a 2:1 system in which the amount of rope used is twice the amount of distance traveled. Also, after one or two redirects, the amount of friction added to the system becomes so high that the climber cannot move any further. While DdRT is relatively simple, it is a slow, energy consuming technique that is also only practical for short ascents.

An alternative tree climbing technique is the single rope technique (SRT). In SRT, one end of a single line of rope is anchored to a fixed object, such as to a branch or trunk of a tree, which is the tie-in point of the system. Essentially any part of a tree can be a tie-in point. The climber attaches to the free end of the line using a separate rope grabbing component such as a friction hitch. The climber ascends the free end of the line using his/her arms and legs, and optionally may utilize a mechanical ascender (typically a one-way, cammed device) for assistance. To descend, the climber typically must switch from the ascender to a separate descender that is attached to the line for descent. SRT is a 1:1 system in which the amount of rope used is equal to the distance traveled, and SRT allows for any number of redirects (including the use of natural crotches) without adding friction to the system. While SRT is more complicated and requires more skill than DdRT (for example due to the necessity to switch to a descending device for descent and to remove the descending device to ascend), SRT is faster than DdRT and requires less energy expenditure on the part of the climber. SRT is also more practical than DdRT for ascent to higher elevations, and SRT allows for greater access to the canopy of a tree.

However, the lack of bidirectional movement when using SRT, and the need to install and remove rigging for descent and any subsequent ascent, is a significant inconvenience of SRT. Changeovers from ascenders to descending devices require a certain level of skill and experience. These changeovers are also cumbersome and time consuming. Further, changeovers can be difficult and dangerous when time is of the essence and/or in moments of panic, such as an attack by a swarm of bees. Therefore, a need exists for an apparatus that allows for bidirectional movement in SRT while eliminating the need to add or remove devices such as ascenders and descenders from the system during the climb.

SUMMARY OF THE INVENTION

The present invention provides a rope climbing apparatus that assists a climber in ascent and descent when using SRT. The present rope climbing apparatus remains on the rope line during ascent and descent, and eliminates the need to switch between ascenders and descending devices, thereby simplifying the transition between ascent and descent. During ascent, the present rope climbing apparatus freely moves along the line of rope, while during descent, the present rope climbing apparatus provides friction along the line of rope, allowing for a controlled descent. The present rope climbing apparatus thereby provides similar service to a climber's hitch in SRT that a tree limb or cambium saver provides in DdRT.

More particularly, a rope climbing apparatus in accordance with the present invention includes a rope receiving portion including a slot for feeding rope therethrough. The slot is defined in part by two spaced, offset friction surfaces. A lever arm extends from the rope receiving portion. The lever arm terminates in a handle. Pivoting of the lever arm rotates the slot between a neutral position in which rope travels freely through the slot and a brake position in which the friction surfaces engage the rope and bend the rope into an S-like shape. The two friction surfaces and the handle may define vertices of a triangle. The distance between the two friction surfaces may be adjustable. Each friction surface may be cylindrical in shape.

In a specific embodiment, a rope climbing apparatus in accordance with the present invention includes two spaced side members. Each side member has a climbing rope end and a tethering end. The climbing rope ends each include a pair of spaced apertures. The tethering ends each include a cooperative aperture. Two friction elements are disposed between the spaced side members. The friction elements are axially disposed between the pair of spaced apertures in the climbing rope end for receiving a rope therebetween the friction elements. A tether connector is axially disposed between the cooperative apertures in the tethering end for connecting a tether thereto. The climbing apparatus is useable as a brake while descending a rope through angular movement of the tethering end relative to the rope.

Each side member may be planar. The side members also may be parallel to each other. The friction elements may each include a cylindrical surface. The tether connector also may include a cylindrical surface. The spaced apertures and the cooperative aperture of each side member may define vertices of a triangle. One of the friction elements may include a ball locking mechanism for quick release of the one friction element from the side members. One side member may be swingable about an axis of one of the friction elements. One of the spaced apertures on each side member may be an elongated slot for adjustable positioning of one of the friction elements in the elongated, slotted apertures. A portion of the side members between the friction elements and the tether connector may define a lever arm.

A rope climbing system in accordance with the present invention includes the rope climbing apparatus as described above. A hitch tending pulley is tethered to the tethering end of the rope climbing apparatus. A climbing rope is inserted through the rope climbing apparatus between the two friction elements, and also inserted through the hitch tending pulley. A friction hitch is placed on the climbing rope between the rope climbing apparatus and the hitch tending pulley. The friction hitch is attached to the hitch tending pulley. A carabiner is attached to the hitch tending pulley for connecting the hitch tending pulley to a user. During descent of a user connected to the system by the carabiner, angular movement of the tethering end relative to the climbing rope forces the climbing rope that is between the two friction elements into a S-like shape to provide braking friction for a controlled descent.

These and other features and advantages of the invention will be more fully understood from the following detailed description of the invention taken together with the accompanying drawings.

BRIEF DESCRIPTION OF THE DRAWINGS

In the drawings:

FIG. 1 is a perspective view of a rope climbing apparatus in accordance with the present invention;

FIG. 2 is a side view of the rope climbing apparatus in a neutral position;

FIG. 3 is a side view of the rope climbing apparatus in a brake position;

FIG. 5 is a side view of an alternative rope climbing apparatus in accordance with the present invention;

FIG. 6 is a side view of an alternative rope climbing apparatus in accordance with the present invention;

FIG. 7 is a schematic view illustrating installation of the rope climbing apparatus on a climbing rope;

DETAILED DESCRIPTION OF THE INVENTION

Figure 4:
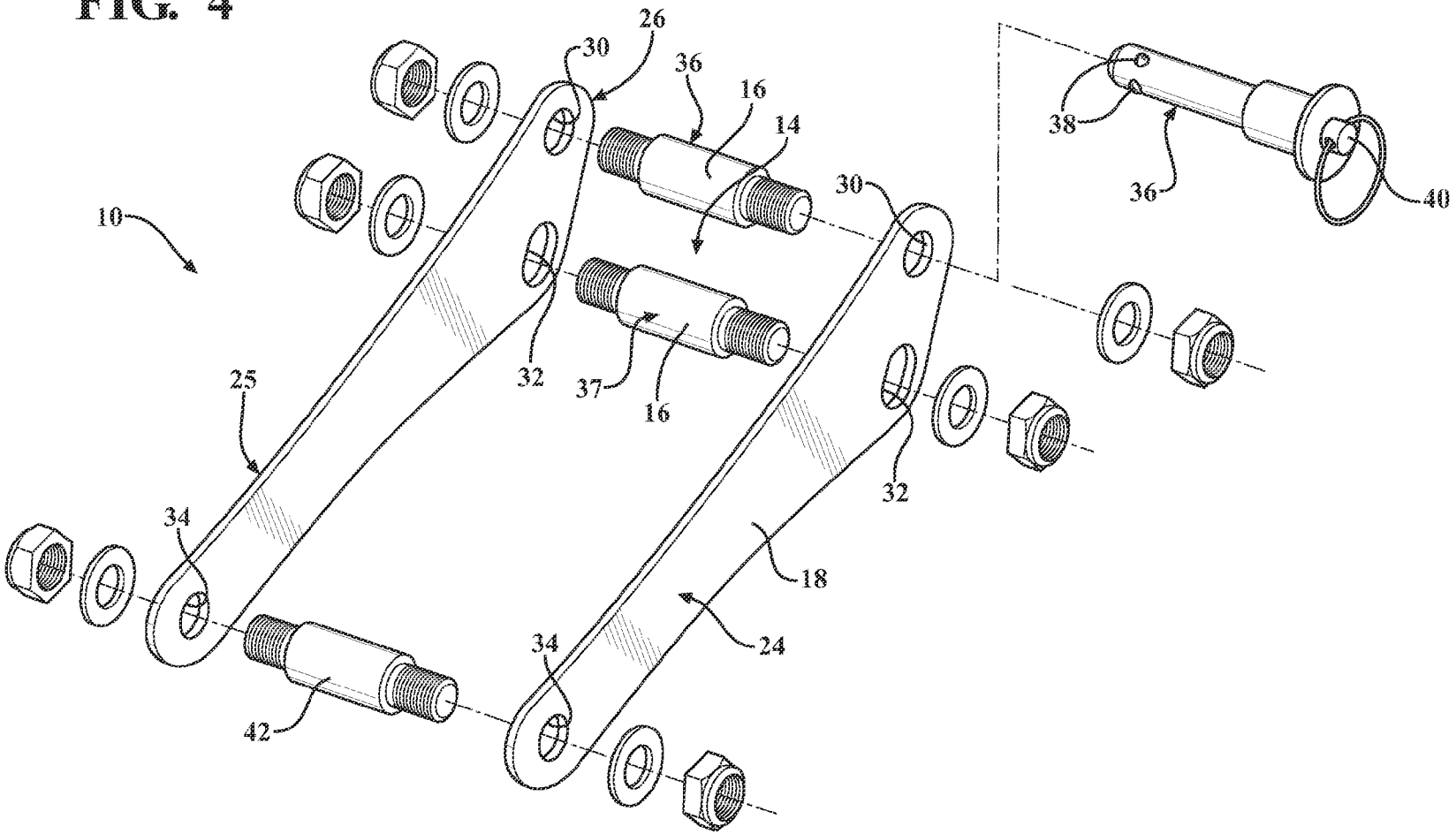
FIG. 4 is an exploded view of the rope climbing apparatus.

Referring now to the drawings in detail, numeral 10 generally indicates a rope climbing apparatus in accordance with the present invention. The rope climbing apparatus 10 assists climbers using SRT and significantly simplifies SRT climbing systems. The rope climbing apparatus 10 serves as a friction assist tool that can remain on the rope line throughout the climb, and the rope climbing apparatus functions like a descender having a neutral gear that allows for unrestrained ascent.

As shown in FIGS. 1 and 4, a rope climbing apparatus 10 generally includes a rope receiving portion 12 including a slot 14 for feeding rope therethrough. The slot 14 is defined in part by two spaced, offset friction surfaces 16. A lever arm 18 extends from the rope receiving portion 12 and terminates in a handle 20. Pivoting of the lever arm rotates the slot 14 between a neutral position (FIG. 2) in which climbing rope 22 travels freely through the slot (generally unrestrained, i.e., essentially no friction on the rope) and a brake position (FIG. 3) in which the friction surfaces 16 engage the rope 22 and bend the rope into an S-like shape.

In a specific embodiment, the rope climbing apparatus 10 includes two spaced side members 24, 25 that are generally parallel to each other. The side members 24, 25 are not limited to any particular shape, and may be a triangular shape, an elongated shape, an elongated triangular shape, a bone shape, a circular shape, or similar. The side member 24 also typically has the same or similar shape as the side member 25. Each side member 24, 25 may be planar (i.e., flat and/or sheet-like); however, the side members are not limited to a flat, sheet-like shape. Each side member 24, 25 has a climbing rope end 26 corresponding to the rope receiving portion 12 and a tethering end 28 corresponding to the handle 20. The climbing rope end 26 of each side member 24, 25 includes a pair of spaced first and second apertures 30, 32 that are offset from each other. The first aperture 30 of the side member 24 is aligned with the first aperture 30 of the side member 25, and similarly the second aperture 32 of the side member 24 is aligned with the second aperture 32 of the side member 25. The degree of offset between the first and second apertures 30, 32 is not particularly limited, but typically the second aperture 32 is below and inward relative to the first aperture 30 when the apparatus 10 is placed upright on a horizontal surface. The tethering end of each side member 24, 25 includes a cooperative, third aperture 34. The third aperture 34 of the side member 24 is aligned with the third aperture 34 of the side member 25. The first, second, and third apertures 30, 32, of each side member 24, 25 define vertices of a triangle, i.e., imaginary lines connecting the first, second, and third apertures form a triangle.

Two friction elements 36, 37 are axially disposed between the spaced apertures 30, 32 in the climbing rope end 26 and connected to the side members 24, 25 via the spaced apertures. One of the friction elements 36 is mounted through the first apertures 30 and the other friction element 37 is mounted through the second apertures 32 such that the space between the two friction elements 36, 37 and the inner surfaces of the side members 24, 25 defines the slot 14 for receiving a climbing rope therebetween the friction elements. The outer surfaces of the friction elements 36, 37 define the friction surfaces 16 which apply friction to a climbing rope when the apparatus 10 is in a braking position. The shape of the friction elements 36, 37 is not particularly limited, although the friction elements may have a curvilinear cross-sectional shape. For example, the friction elements 36, 37 may be cylindrical in shape having a cylindrical outer surface and a circular cross-section. However, the friction elements do not have to be cylindrical. Instead, the friction elements may have an irregular shape so that the surface area of the friction surfaces 16 are maximized to provide the greatest amount of friction in the brake position. The friction surfaces 16 may be generally smooth so that when the friction elements 36, 37 can apply friction to a climbing rope without abrading the rope or otherwise causing excessive wear to the rope as it travels through the slot 14. Also, while the friction elements 36, 37 are shown as having the same sized cross-section, one friction element may have a larger cross-section than the other friction element. For example, the friction element 36 may have a larger diameter (and thus a larger circumference) than the friction element 37.

The friction elements 36, 37 may include threaded bolts on either end that are smaller in diameter than the friction surfaces 16. The threaded bolts fit through the apertures 30, 32 in the side members 24, 25, while the larger diameter body of the friction elements does not. Nuts on each threaded bolt releasably secure the friction elements 36, 37 to the side members 24, 25. Optionally, as shown in FIG. 4, friction element 36 may include a ball locking mechanism including releasable balls 38 and a release 40 that upon depression allows the balls to move inwardly from a locked position to an unlocked position. The ball locking mechanism allows the apparatus 10 to be easily installed on climbing rope midline rather than at an end of the climbing rope, as described in more detail below.

The first apertures 30 and the second aperture 32 through which the friction elements 36 are mounted may be generally circular in shape. Optionally, however, the second apertures 32 on the side members 24, 25 may be elongated slots for adjustable positioning of one the friction element 37 along the length of the elongated, slotted apertures 32. Movement of the friction element 37 in the slotted second apertures 32 adjusts the size of the slot 14. Adjusting the slot 14 size allows for use of various sizes of climbing rope and also for the varying of the amount of friction provided by the apparatus 10 on the climbing rope. The slot 14 can be widened for larger-sized rope and made smaller for smaller-sized rope. Also, the smaller the slot 14 size (i.e., the closer the friction element 37 is to the friction element 36), the more friction that the apparatus 10 can apply to a climbing rope during descent. Thus, the combination of rope size and the desired level of friction determine the placement of the friction element 37 along the second aperture 32. Generally, the friction elements 36, 37 should be spaced so that they are slightly wider apart than the diameter of the rope or just touching the climbing rope and not so tight that the apparatus 10 drags along the climbing rope during ascent. Alternatively, the friction element may have a lobed cam surface that is cooperable with the slotted aperture 32 for adjustment of the position of the friction element 37. In another arrangement, adjustment of the friction element may be effected by providing a plurality of second apertures through which the friction element 37 may alternatively positioned.

A tether connector 42, which defines in part the handle 20 of the apparatus 10, is axially disposed between the third apertures 34 in the tethering end 28 and connected to the side members 24, 25 via the third apertures. The tether connector 42 may be cylindrical in shape having a cylindrical outer surface and a circular cross-section, and may be a spacer between the side members 24, 25. The tether connector 42 may include threaded bolts on either end that are smaller in diameter than the cylindrical outer surface. The threaded bolts fit through the third apertures 34 in the side members 24, 25, while the larger diameter body of the tether connector does not. Nuts on each threaded bolt releasably secure the tether connector 42 to the side members 24, 25. A tether can be connected to the tether connector 42 by, for example, a girth hitch around the outer surface of the tether connector. The tether connector alternatively may include a loop through which the tether can be attached.

The distance between the side members 24, is fixed by the length of the friction elements 36, 37 and the tether connector 42 that are disposed between the side members. The distance between the side members 24, 25 is not particularly limited but generally should be set to accommodate a desired range of rope sizes. The distance should be as great as the diameter of the maximum desired rope size, so that the inner surfaces of the side members 24, 25 do not restrict movement of the rope through the slot 14. On the other hand, the distance should not be much greater than maximum desired rope size so that there is not excessive sideways play in the climbing rope as it travels through the slot 14.

A portion of the side members 24, 25 between the friction elements 36, 37 and the tether connector 42 defines the lever arm 18. Movement of the tether connector 42 pivots the lever arm 18 about the climbing rope end 26 when the apparatus 10 is installed on a climbing rope, and thereby manipulates the climbing rope via the friction elements 36, 37. The distance between the friction elements 36, 37 and the tether connector 42 is not particularly limited, but does determine the length of the lever arm 18 and thus the amount of mechanical advantage provided by the lever arm on the climbing rope between the friction elements.

Optionally, as shown in FIG. 5, one of the side members 124 may be swingable about an axis of the friction element 136. The second aperture 132 has an open end (i.e., is a notch along the edge of the side member 124) so that the side member 124 can release from the friction element 137. Optionally, the tether connector may include a quick release mechanism such as a ball locking mechanism so that the tether connector can be easily removed to allow the side member 124 to swing open, and easily inserted an secured once a climbing rope is disposed between the friction elements. This arrangement allows the apparatus 110 to be midline attachable so that the apparatus can be installed anywhere along the line of climbing rope (as opposed to just at an end).

Alternatively, one of the friction elements of the rope climbing apparatus may be attached to an arm that is pivotally connected to one of the side members along an outer surface of the side member. The friction element is rotatable between an open position and a closed position. In the open position, the rope climbing apparatus may be positioned along a length of the climbing rope such that the climbing rope is disposed between the two friction elements. The pivotable friction element is then moved to the closed position to keep the climbing rope in the rope climbing apparatus. Thus, this arrangement also allows the rope climbing apparatus to be midline attachable.

In an alternative embodiment shown in FIG. 6, a rope climbing apparatus 210 is a single, integral piece of material made of wood, plastic, aluminum, or similar. The rope climbing apparatus 210 has a rope receiving portion 212 including a slot 214 for feeding rope therethrough. The slot 214 has two spaced, offset friction surfaces 216. A lever arm 218 extends from the rope receiving portion 212, and a handle defined by an aperture 220 for connecting a tether thereto is disposed at an end of the lever arm opposite the rope receiving portion. Pivoting of the lever arm 218 rotates the slot 214 between the neutral position in which climbing rope (not shown) travels freely through the slot (generally unrestrained, i.e., essentially no friction on the rope) and a brake position in which the friction surfaces 216 (which are of the material of construction of the apparatus 210, e.g., wood) at both ends of the slot 214 engage the rope and bend the rope into an S-like shape. The frictional properties of the material of construction relative to the climbing rope thereby affect the amount of friction applied by the rope climbing apparatus 210 against the climbing rope in the brake position.

Figure 8:
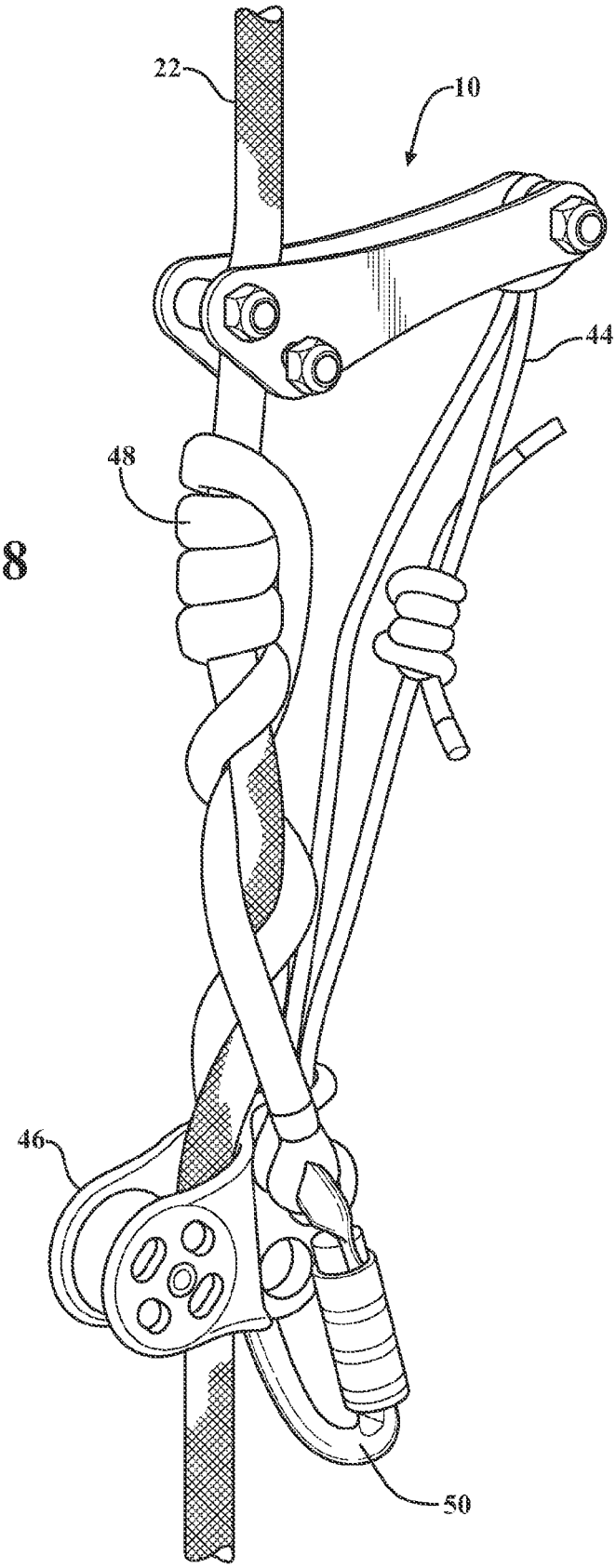
FIG. 8 is another schematic view illustrating installation of the rope climbing apparatus on the climbing rope.
Figure 10:
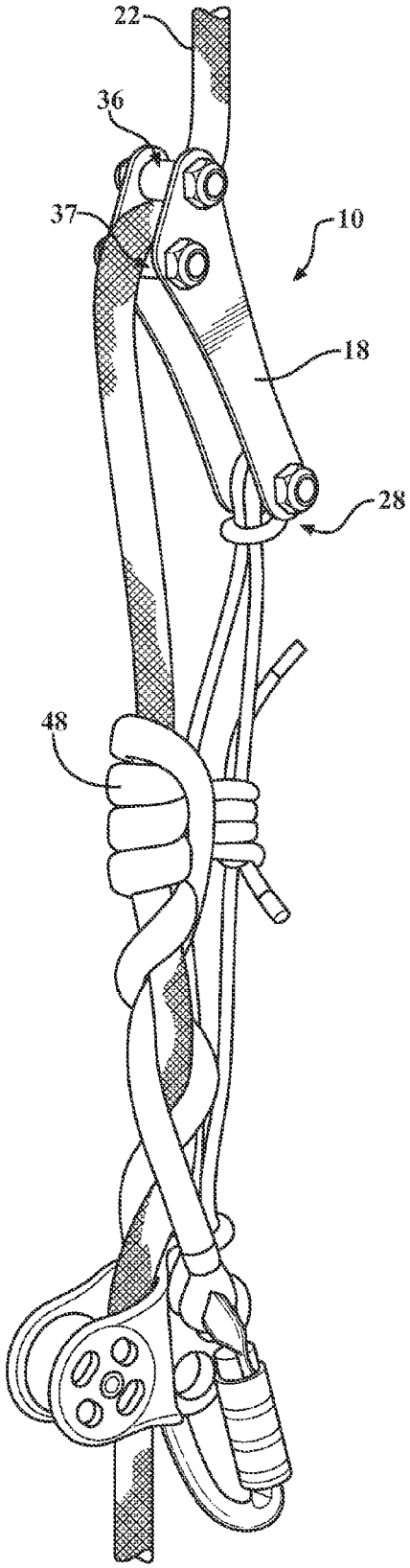
FIG. 10 is a schematic view illustrating the rope climbing apparatus during descent of the climber down the climbing rope.

With reference now to FIGS. 7, 8, and 10, the rope climbing apparatus 10 is used in combination with other climbing devices in a SRT climbing system. To install the rope climbing apparatus 10, the slot size is set based on the size of the climbing rope 22 and the desired friction level by adjusting the positioning of the friction element 37 in the second apertures 32 as described above. As shown in FIG. 7, one end of a tether 44 is connected to the handle 20 of the rope climbing apparatus by a girth hitch, and the other end of the tether is connected to a hitch tending pulley 46 (hitch climber, slack-tender pulley) by a girth hitch. The tether should be long enough that it does not restrict the pivoting movement of the rope climbing apparatus 10 and does not interfere with the friction hitch (see below). However, the tether should not be so long that it easily twists around the climbing rope 22. After connecting the tether 44, the climbing rope 22 is then inserted through the slot 14 in the rope climbing apparatus 10 between the two friction elements 36, 37, and also inserted through the hitch tending pulley 46. As shown in FIG. 8, a friction hitch 48 such as a split tail Blake's hitch or similar is placed on the climbing rope 22 between the rope climbing apparatus 10 and the hitch tending pulley 46, and the friction hitch is also attached to the hitch tending pulley. A carabiner 50 is attached to the hitch tending pulley 46 for securely connecting the hitch tending pulley 46 to a user, i.e. the climber.

Figure 9A:
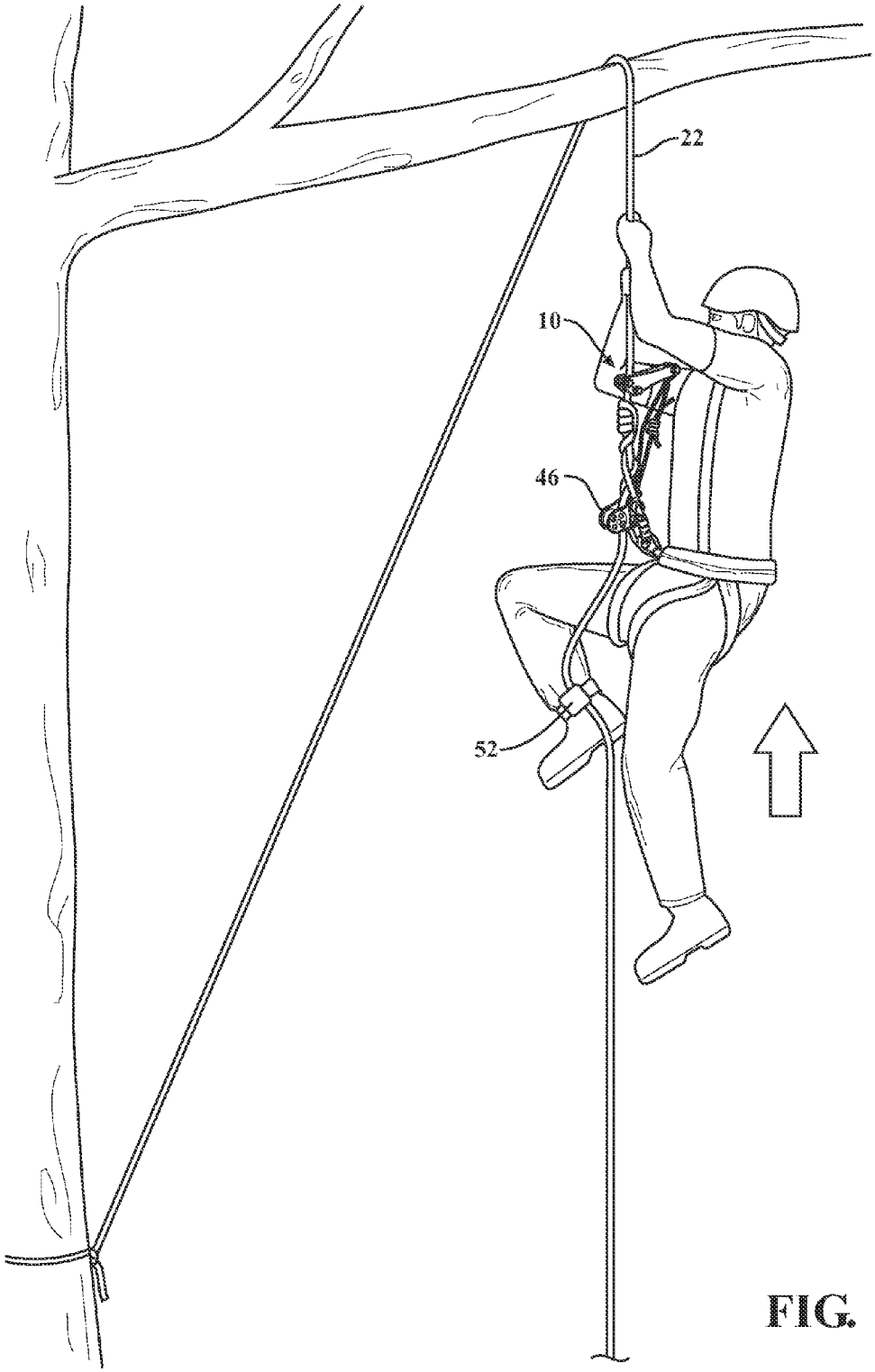
FIG. 9A is an environmental view of the rope climbing apparatus during use by a climber during ascent.

As shown in FIG. 9A, when the climber ascends the rope 22, the rope climbing apparatus 10 is in the neutral position. The climber may use a conventional ascender such as a foot ascender 52 or similar to assist in the ascent. The climber can grip the rope climbing apparatus 10 to pull the hitch tending pulley 46 up the rope 22 as the climber ascends. Also, the climber can additionally use a chest harness, a climber's lanyard, and/or other similar device to hold the rope climbing apparatus 10 and hitch tending pulley 46 high on the rope (relative to the climber) during ascent. The hitch tending pulley 46 should be kept above the climber's waist level at all times during the ascent to prevent introducing slack into the system.

Figure 9B:
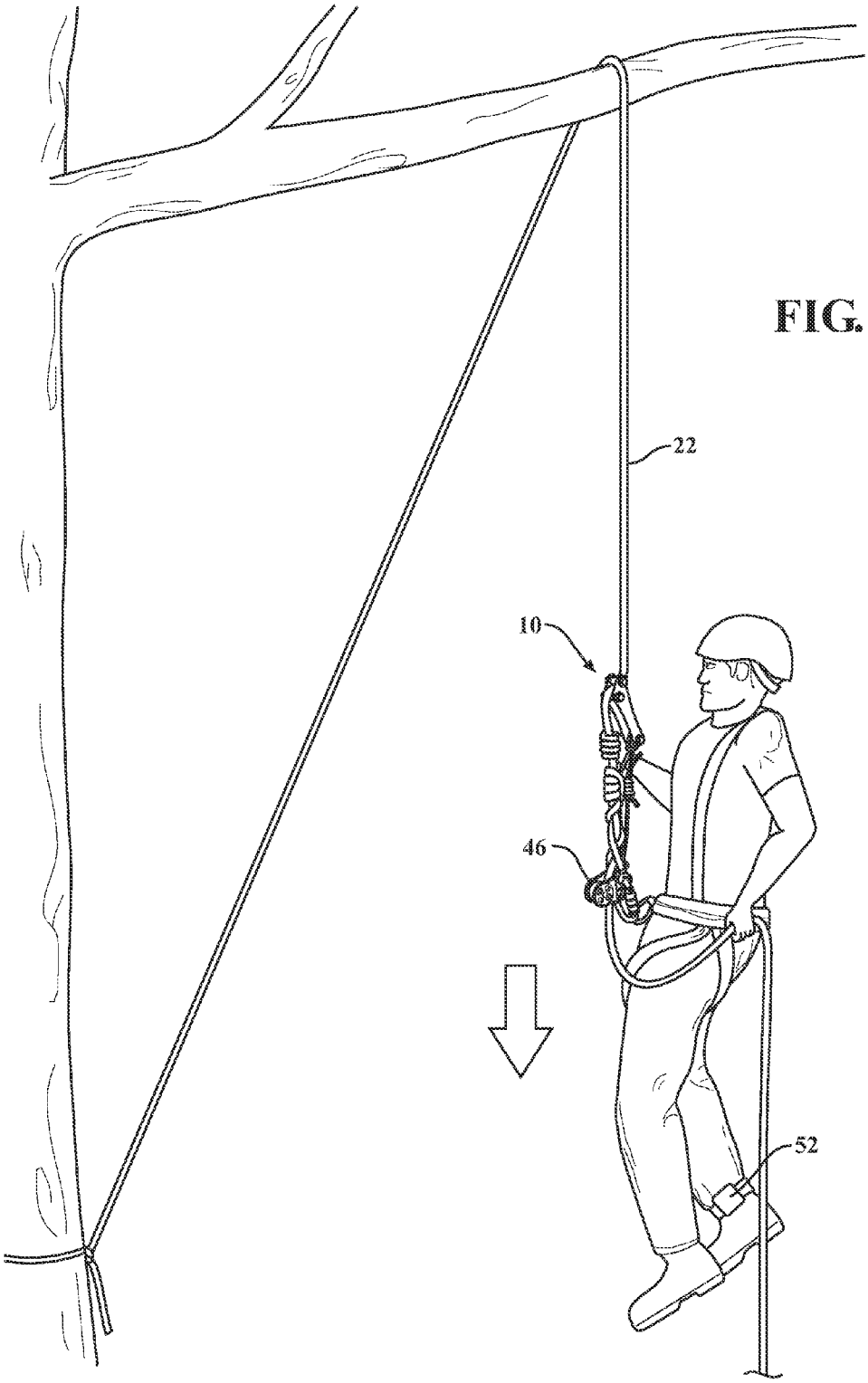
FIG. 9B is an environmental view of the rope climbing apparatus during use by a climber during descent.

Turning to FIG. 9B, when the climber desires to descend, the rope climbing apparatus 10 is manipulated into the brake position. Once the rope climbing apparatus 10 is in the brake position in which the friction surfaces 16 engage and bend the climbing rope 22, As shown in FIGS. 9B and 10, in order to descend, the climber first manually engages the rope climbing apparatus 10 by grasping the lever arm 18 and pulling downward so that the apparatus is in the brake position. The angular movement of the tethering end 28 relative to the climbing rope 22 forces the climbing rope that is between and on either side of the two friction elements 36, 37 into a S-like shape to provide braking friction for a controlled descent. The climber also disengages the ascender 52 (if present) from the climbing rope 22. After the apparatus 10 is in the brake position, the climber then can disengage the friction hitch 48 (using one hand) and slowly descend down the rope 22. To stop downward movement, the climber lets go of the friction hitch 48, which causes the friction hitch to engage the climbing rope 22 and thus to halt the climber's movement.

Although the invention has been described by reference to specific embodiments, it should be understood that numerous changes may be made within the spirit and scope of the inventive concepts described. Accordingly, it is intended that the invention not be limited to the described embodiments, but that it have the full scope defined by the language of the following claims.

What is claimed is:

1. A rope climbing system comprising:

a rope climbing apparatus including:

two spaced side members;

each side member having a climbing rope end and a tethering end;

said climbing rope ends each including a pair of spaced apertures;

said tethering ends each including a cooperative aperture;

two friction elements disposed between said spaced side members;

said friction elements being axially disposed between said pair of spaced apertures in said climbing rope end for receiving a rope therebetween said friction elements; and a tether connector being axially disposed between said cooperative apertures in said tethering end for connecting a tether thereto;

whereby said climbing apparatus is useable as a brake while descending a rope through angular movement of said tethering end relative to the rope;

a hitch tending pulley tethered to said tethering end of said rope climbing apparatus;

a climbing rope inserted through said rope climbing apparatus between said two friction elements, and also inserted through said hitch tending pulley;

a friction hitch placed on said climbing rope between said rope climbing apparatus and said hitch tending pulley, said friction hitch being attached to said hitch tending pulley; and a carabiner attached to said hitch tending pulley for connecting the hitch tending pulley to a user;

whereby, during descent of a user connected to said system by said carabiner, angular movement of said tethering end relative to the climbing rope forces the climbing rope that is between said two friction elements into a S-like shape to provide braking friction for a controlled descent.

* * * * *